United States Patent [19]

Miller et al.

[11] Patent Number: 4,970,820

[45] Date of Patent: Nov. 20, 1990

[54] DEVICE FOR RAPIDLY LOADING RIMMED CARTRIDGES INTO LARGE CAPACITY FIREARM MAGAZINES

[76] Inventors: Michael K. Miller; Warren D. Stockton, both of 405 E. 19th St., Bakersfield, Calif. 93305

[21] Appl. No.: 431,214

[22] Filed: Nov. 3, 1989

[51] Int. Cl.[5] ..... F41A 9/83
[52] U.S. Cl. ..... 42/087
[58] Field of Search ..... 42/87, 88

[56] References Cited

U.S. PATENT DOCUMENTS

| | | | |
|---|---|---|---|
| 341,371 | 5/1886 | Bruce | 42/87 |
| 2,451,521 | 10/1948 | Uglum | 42/87 |
| 3,628,273 | 12/1971 | Lach | 42/87 |
| 4,739,572 | 4/1988 | Brandenburg | 42/87 |
| 4,879,829 | 11/1989 | Miller et al. | 42/87 |

FOREIGN PATENT DOCUMENTS

| | | | |
|---|---|---|---|
| 0752914 | 7/1956 | United Kingdom | 42/87 |
| 8801042 | 2/1988 | World Int. Prop. O. | 42/87 |

*Primary Examiner*—Charles T. Jordan
*Assistant Examiner*—Michael J. Carone
*Attorney, Agent, or Firm*—Roylance, Abrams, Berdo & Goodman

[57] ABSTRACT

An improved ammunition loading device designed for cartridges having radially extending rims, such as 0.22 calibre cartridges. The invention comprises a body having a spiral groove and a feed arrangement to drive the cartridges through the groove and into a magazine. A manual crank has an eccentric cam which operates two mechanisms alternately on each rotation of the crank. On half the rotation it operates a feed finger which inserts the next cartridge exiting the spiral groove into the magazine, and on the other half of that same rotation it advances the line of cartridges to present a fresh cartridge for insertion on the first half of the next rotation.

39 Claims, 5 Drawing Sheets

FIG. 3
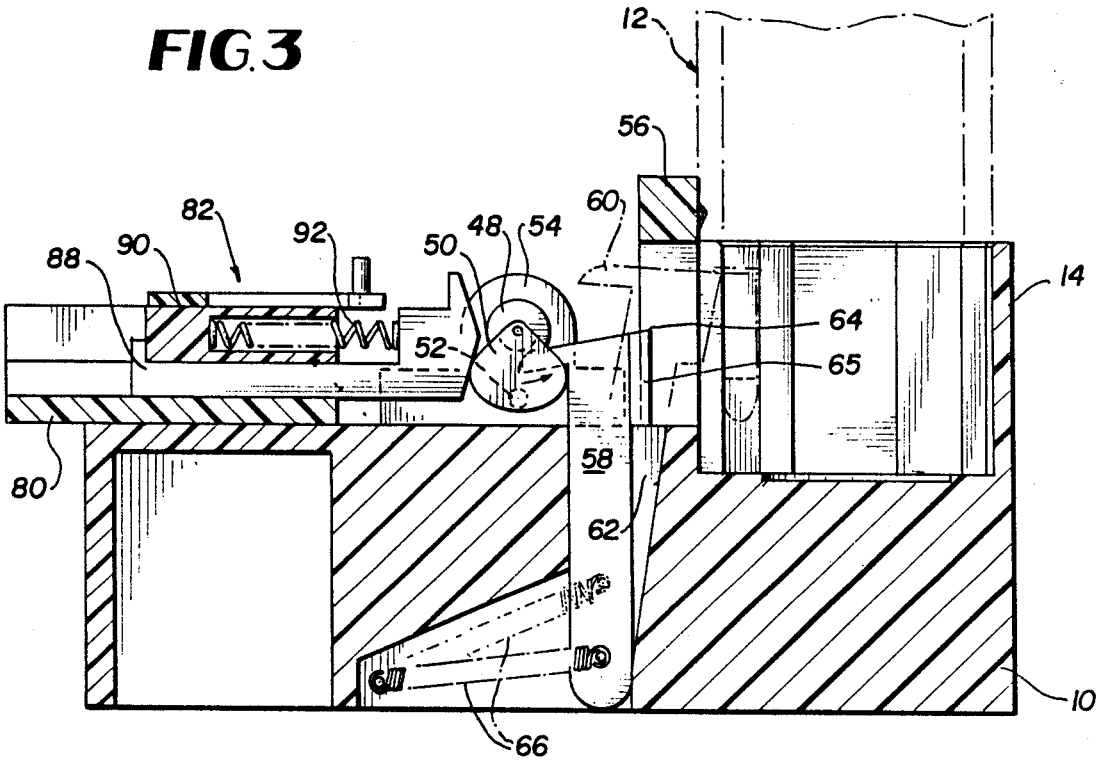
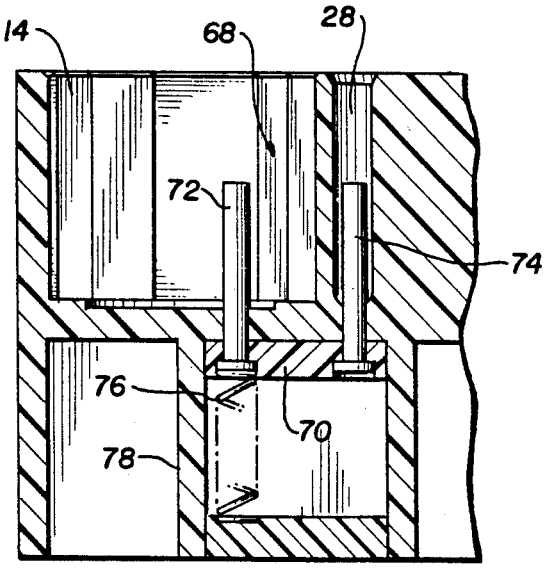
FIG. 4
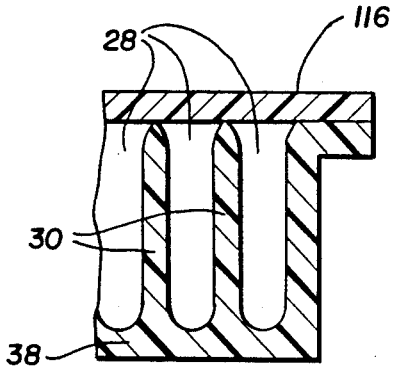
FIG. 5A

FIG. 6
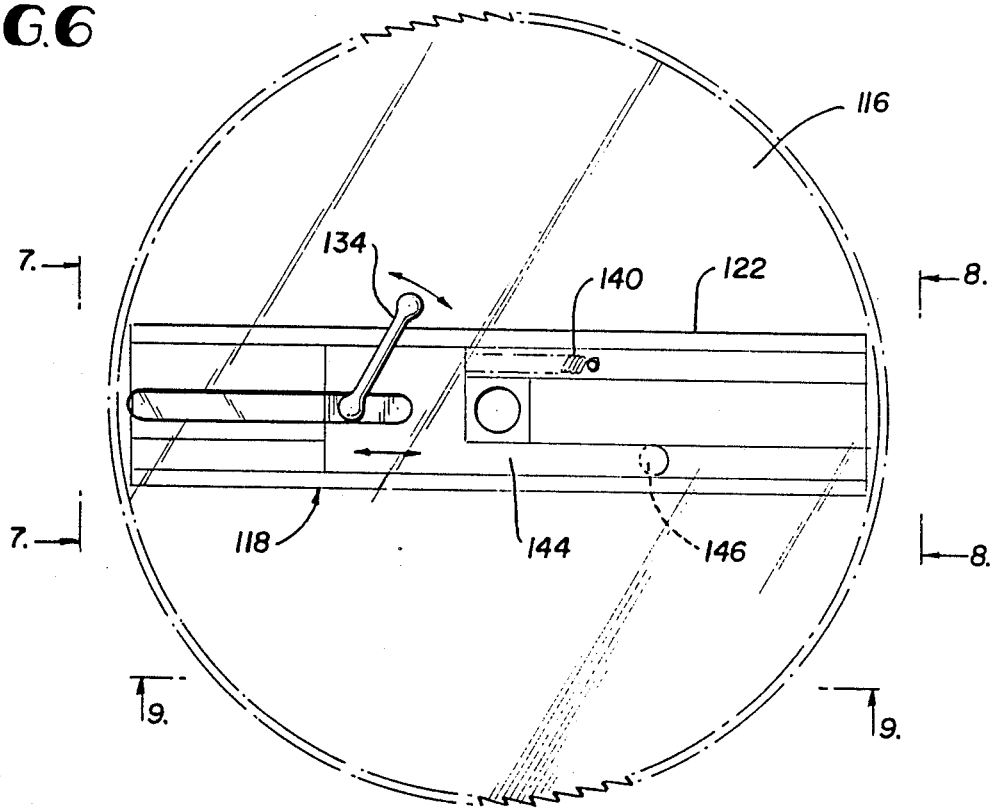
FIG. 7
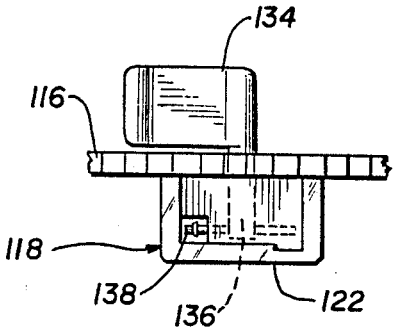
FIG. 8
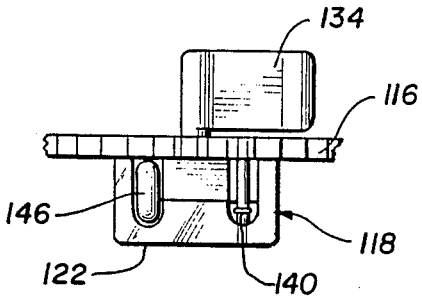
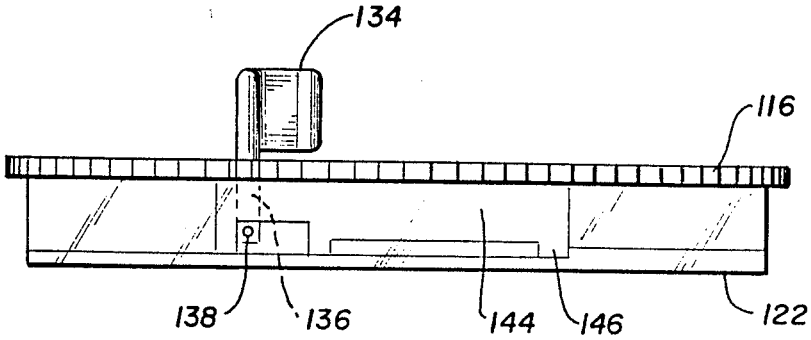
FIG. 9

DEVICE FOR RAPIDLY LOADING RIMMED CARTRIDGES INTO LARGE CAPACITY FIREARM MAGAZINES

REFERENCE TO RELATED PATENTS

Our prior patents listed below relate to a gun and magazine system for which the present invention was specifically developed. That is, the present invention was developed to load 100 rimmed cartridges into a magazine for use in such a system. The present invention cannot load cartridges which do not have a rim which extends radially outwardly of the body of the cartridge. Specifically, the invention was developed for loading .22 caliber cartridges. However, the invention can be used for loading rimmed cartridges of any size.

| U.S. Pat. No. | Title | Patentee |
|---|---|---|
| 4,766,800 | Gun & Magazine System | Miller et al |
| 4,738,183 | Clam Shell Construction Ammunition Magazine | Miller & Stockton |
| 4,676,137 | Weapon Firearm w/ Magazine | Stockton et al |
| D303,418 | A Firearm | Miller et al |
| D303,419 | A Pistol | Miller et al |

FIELD OF THE INVENTION

The present invention relates to firearm systems, and more particularly it relates to a device for rapidly loading large quantities, on the order of 100, cartridges into such large capacity magazines.

BACKGROUND OF THE INVENTION

One of the major objectives of small arms design is to increase the number of successive shots that may be fired without reloading. This is evidenced by the historical progression from flintlocks to revolvers to modern magazine-fed semi-automatic rifles. Our prior patents identified above disclose a cylindrical, helical feed magazine for firearms that is capable of delivering 100 rounds to a suitable firearm without interruption, and which has been subsequently manufactured in commercial quantities for .22 caliber rimmed cartridges. However, manually inserting 100 cartridges into a magazine one at a time is a tedious process. Previously available rapid loading devices and designs are not capable of properly orienting such a large number of cartridges or of successfully inserting them into a magazine without intermediate manipulations. The present invention is a new and unique improvement in the art of firearm magazine loading devices, offering substantial advantages of increased cartridge capacity, simplicity of operation, and functional reliability.

SUMMARY OF THE INVENTION

The basic elements of the present invention are a body formed with a spiral slot that orients and aligns the cartridges; a manually rotated eccentric cam which alternately cycles a ratchet system to advance the cartridges and simultaneously drives a spring loaded "finger" that inserts them into the magazine; and a receptacle or socket to hold the magazine in the proper position to receive the cartridges. The body is formed with an upstanding wall which defines a well positioned over the spiral slot. The spiral slot is positioned with its axis vertical, i.e., generally horizontally during loading of the cartridges into the slot. After the large number of cartridges are positioned in the spiral slot, a lid, which carries the spring loaded drive finger, is positioned in the well over the top of the slot, and the finger enters the slot in order to drive the cartridges through the slot and into the magazine.

The .22 caliber cartridges for which the invention was specifically, but not exclusively, developed, have a protruding rim or flange around the base and a heavy projectile at the nose which naturally causes them to fall nose down into the horizontally positioned spiral slot. The slot is only slightly wider than the diameter of the cylindrical cartridge body, and of sufficient depth and length to easily accept 100 (or more) loose cartridges.

The large number of cartridges are simply "dumped" into the well at the top of the slot. Then the user grasps the body and shakes it. This motion causes the noses of the cartridges to fall into the slot, in proper alignment, and uniformly oriented nose down and suspended by their protruding rims at the top of the slot.

A flat disk, forming part of the lid assembly, has regularly spaced ratchet teeth around it's circumference. The lid fits into the well and covers the top of the spiral slot to secure the cartridges therein. Drive means cooperate with the ratchet teeth to cause the lid to rotate around a fixed shaft at the center of the spiral slot. The lid has a radial track that carries a downward extending and pivoting follower which is normally stopped by a spring in the proper position to enter a narrowed bay at the inner terminus of the spiral slot when the lid is installed into the well. This radial follower carries the spring loaded prime finger.

This bay is made more shallow and narrower than the slot to assure that cartridges cannot fall therein or be accepted therein. Thus, even if the spiral slot is substantially entirely full of cartridges, still there will be room for the follower and the drive finger to cooperate with the slot at the inner end thereof to assure that all of the cartridges will be driven through the slot and into the magazine. The rotating lid is restrained by means of a spring loaded latch which engages a groove around the fixed shaft, so that the cartridges cannot escape as the sliding follower and the drive finger push them around the spiral slot. The lid is intermittently advanced an arcuate distance about its axis and around the spiral slot corresponding to the diameter of a single cartridge, by means of a pawl which is urged by a spring to engage the ratchet teeth on the lid.

The follower is pivotally attached to a slider block which moves in a track tangent to the radius of the lid. The track is defined by a housing which is fixed to the disk of the lid assembly. The housing and disk are made integral with each other. After the disk is fitted into the well, it is normally rotated until the cartridges form a solid mass at the outer most portions of the spiral track. The cartridges are then ready to be inserted into the magazine.

The lid is driven by a lost motion pawl and ratchet assembly. The ratchet assembly includes a shuttle member mounted in the wall of the main body outwardly of the spiral track. However, portions of this pawl and ratchet drive assembly extend through the wall for cooperation with the teeth on the lid. The shuttle is advanced by an eccentric cam which is manually rotated with a crank handle on a fixed axis perpendicular to the shuttle track. A linear compression spring returns the shuttle to its starting position, causing the pawl to "skip" back and re-engage the toothed circumference of the lid. A secondary spring loaded pawl on a fixed pivot prevents the lid from being dragged backwards by the returning shuttle pawl. The ratchet drive mechanism is protected from potentially damaging overloads which could be caused by the variable ratio of radial movement required to advance the decreasing number of cartridges exactly one cartridge diameter, between the variable radius spiral and the fixed radius ratchet, or by an accidental "jam". This is done with an appropriately calibrated compression spring between the shuttle block and a "buffer" that slides within the shuttle on a parallel axis and rides on the cam. The cam alternately contacts a cylindrical boss protruding from the flat longitudinally extended "L" shaped loading finger approximately midway between two opposed cylindrical axes near the end of the long side and a concave cartridge yoke at the end of the short side. The loading finger simultaneously rotates and slides in opposed parallel slots integral with, and perpendicular to, the racket shuttle track. A light extension spring attached to the finger keeps it clear of each advancing cartridge until it is contacted by the rotating cam.

The loading finger is first cammed forward in an arc around its axis so the concave yoke can trap a properly positioned cartridge below the rim and push it directly into the magazine's loading port. As the cam continues to rotate it lifts the finger along its linear track which simultaneously lifts the cartridge by the rim and slides it linearly under the magazine's restraining feed lips. The finger is then released by the cam and snaps back into position under the influence of the spring to repeat the cycle.

As thus far described, the main body carries the cam mounted on a handle and is integral therewith. To one side of the cam is the ratchet drive, and to the other side of cam is the loading finger. Thus, for each rotation of the cam, at one position the ratchet mechanism is operated, and at the opposite position, approximately 180 degrees around the axis of rotation of the cam, the loading finger is operated, to load a cartridge into the magazine.

The preferred embodiment of the invention includes a number of injection molded, preferably clear plastic parts, except, of course, for the required springs and fasteners. A clear plastic shield is removably installed on the main body to prevent interference with the pawls and shuttle block. This shield carries an arrow or other permanent mark on its exterior surface to which a similar mark on the lid must be aligned when it is installed in the well to properly orient the drive finger in its bay. The bay is necessarily narrower than the spiral slot so that it cannot be blocked by cartridges. When the follower pushes the last cartridge into loading position it is trapped under a fixed stop that maintains the cartridges in their vertical position, and the lid cannot be removed.

In the preferred embodiment, the fixed pivot pawl has an integral lever extending through a slot in the cover which may be manually operated to disengage both pawls, allowing the lid and follower to be rotated backwards and removed. A sliding arm, integral with the follower and of specific length to block the disengagement of the lid latch from the shaft when the follower is trapped, prevents accidental damage to the ratchet system.

A spring loaded "U" shaped plunger is installed in a vertical track from the back side of the loader, with one leg extending upward through the floor of the magazine socket and the other blocking the exit terminus of the spiral slot. This plunger extends below the floor of the spiral slot, as does the arc of motion of the crank handle. Portions of the loader's main body are extended to provide adequate clearance for moving parts, and the like, as needed.

The invention's rotating drive mechanism is a significant improvement over the prior art of rapid magazine loading systems that depend on gravity to induce the cartridges into the proper loading position and employ a manual track guided plunger to insert the cartridges. It has been found that gravity feed systems are unreliable, especially with rimmed and disproportionately unbalanced cartridges such as the commercial .22 caliber types are to be loaded. It has also been found that when loaders with manual plungers are cycled rapidly, the operators frequently tend to short stroke and subsequently jam the mechanism. The invention's mechanical feed system driven by a positive displacement rotating eccentric, together with its simple, high capacity cartridge orienting means, ease of operation, and reliability enhancing features combined in the compact, inexpensive unit described herein represents a substantial improvement in the art of ammunition magazine loading devices. The invention may be easily adapted for all firearm cartridges having radially extending rims and all appropriate magazines, and is not limited to the particular cartridge and magazine employed in the preferred embodiment shown and described herein.

Thus, there is provided a rapid loader for large numbers of cartridges which is highly efficient, highly reliable and inexpensive, and which represents a substantial and perhaps even an unprecedented step forward in its art.

The invention will be best understood from the following detailed description and claims when read together with the attached drawing also forming a part of this disclosure.

BRIEF DESCRIPTION OF THE DRAWINGS

FIGS. 3, 4 and 5 are partial cross-sectional views taken on lines 3—3, 4—4 and 5—5 respectively of FIG. 2;

FIG. 5A is an enlarged view similar to part of FIG. 5 which shows a modification of a feature;

FIG. 6 is a bottom plan view of the lid assembly;

FIGS. 7, 8 and 9 are partial elevational views taken on lines 7—7, 8—8 and, 9—9 respectively of FIG. 6;

DETAILED DESCRIPTION OF THE PREFERRED EMBODIMENTS

Figure 1:
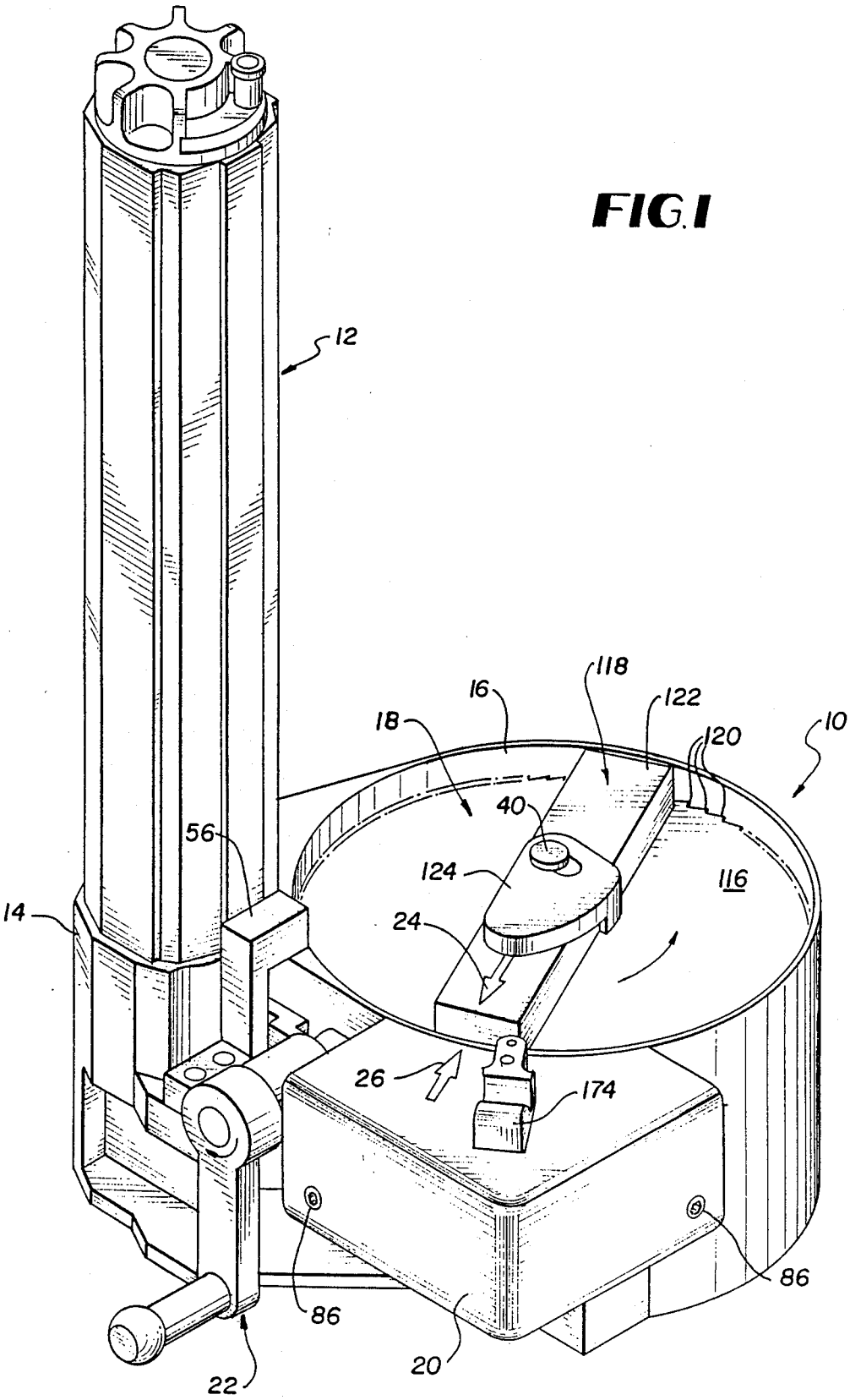
FIG. 1 is a perspective view showing a magazine in its socket in the invention loader ready for loading.

FIG. 1 shows the invention loader 10 positioned to load cartridges into a magazine 12. The invention loader 10 is a one piece member which includes an integrally formed socket 14 into which the magazine 12 is snugly fitted.

Reference should be had to our prior patents identified above for more details about the magazine 12. To the extent such disclosure is required to complete the teaching of this patent application, all of such disclosure of our prior patents is hereby incorporated by reference as if here set forth in full.

The invention loader 10 is formed with an upstanding cylindrical wall 16 which defines a well. This well is positioned over the top of the spiral cartridge slot, shown in other drawings and described more in detail below. The lid assembly 18 fits within the well defined by the wall 16 and is positioned at the top of the spiral slot. A ratchet housing 20 is joined to the side of the invention loader including a portion of the well defining wall 16 for cooperation with the lid assembly, in a manner described in more detail below. An operating handle assembly 22 has its axis positioned horizontally in the position of use as shown in FIG. 1, and radially of the well defined by the wall 16. A pair of indicating arrows are provided, an arrow 24 on the lid assembly 18, and a matching arrow 26 on the ratchet housing 20. These arrows serve a function in use of the invention, as will be described in greater detail below.

Figure 2:
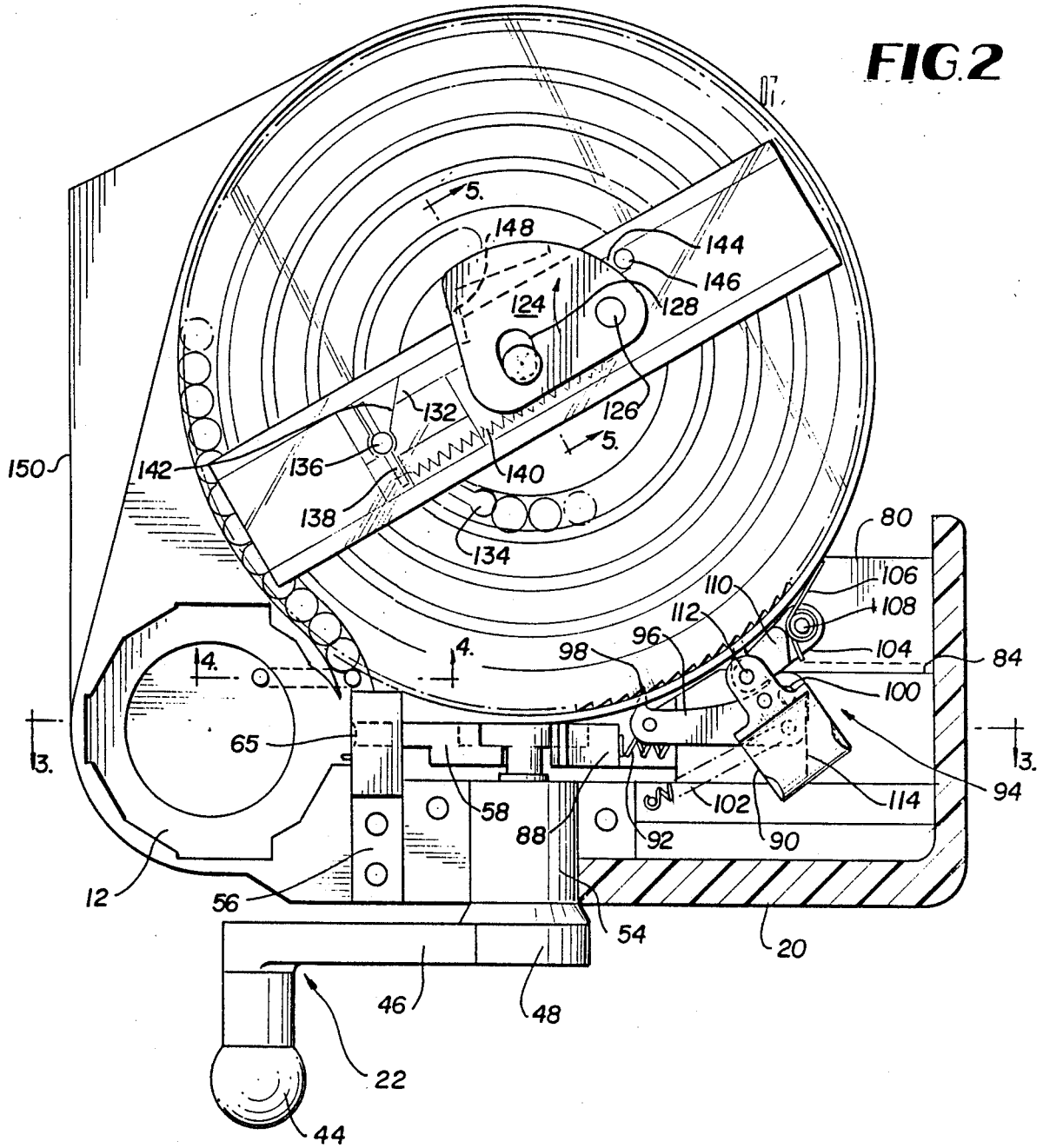
FIG. 2 is a top plan view thereof.
Figure 10:
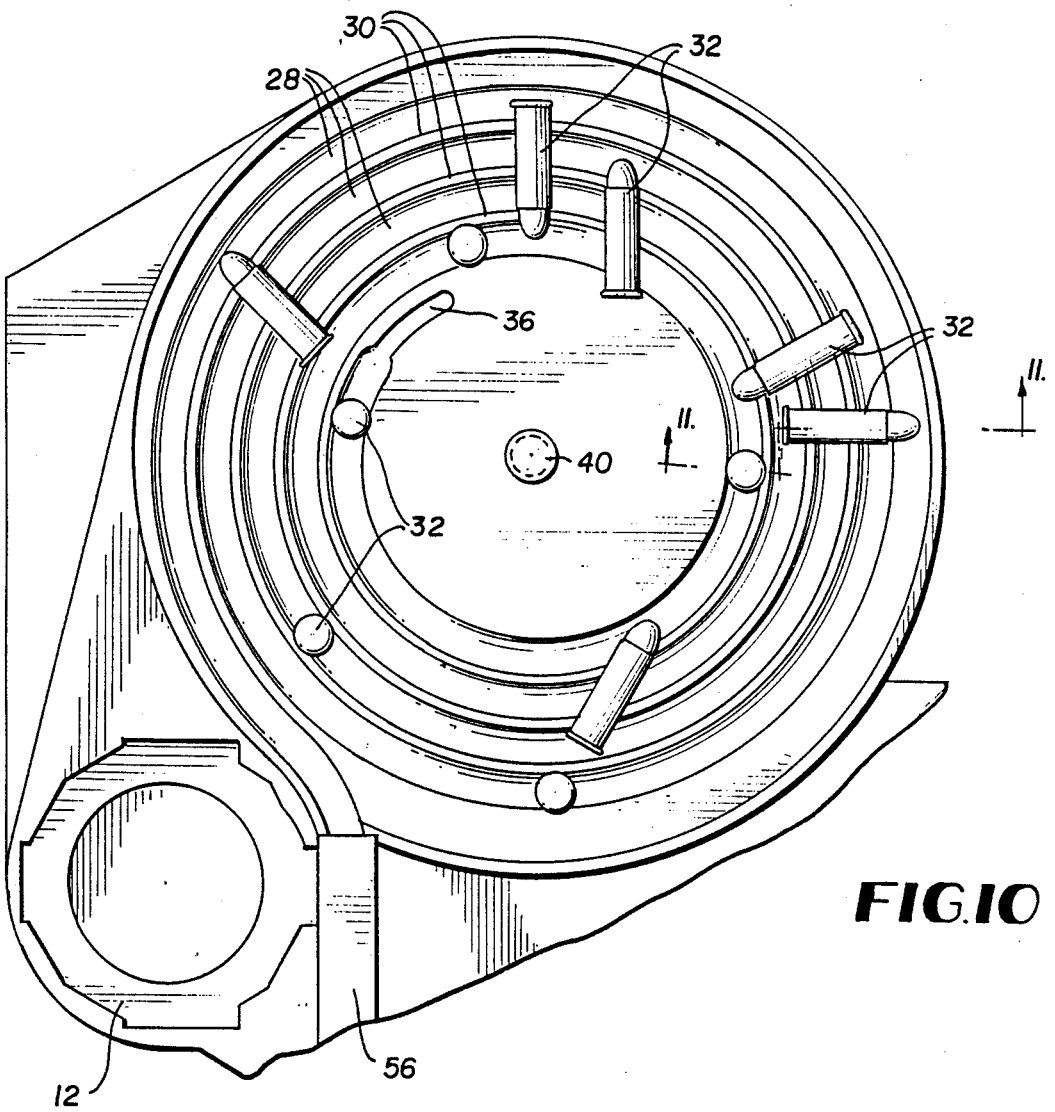
FIG. 10 is a top plan view of the invention loader with the lid removed showing the manner in which the cartridges are "dumped" randomly onto the top of the spiral slot.

Referring now to FIGS. 2, 5, 10 and 11, the main body of the invention loader is formed with a helical wall 30 which defines a spiral groove or slot 28 between its spiral flights. Of course, as shown in FIGS. 2 and 10, the end of this spiral groove 28 communicates with the space inside the socket 14 in order to permit the cartridges to exit from the spiral slot and enter the magazine 12 when it is in the socket 14.

The preferred embodiment of the invention was developed to load .22 caliber cartridges 32, each of which has an enlarged radially outwardly extending rim 34. As is shown most clearly in FIG. 11, the width and depth of the spiral groove 28 is made so as to comfortably and loosely accommodate the cartridges 32. The top edges of the spiral wall 30 are formed so as to permit each cartridge to hang into the groove suspended by its rim 34. The slightly pointed top edge of the spiral wall 30 facilitates motion of the cartridges through the spiral groove 28, to permit their loading into the magazine 12, as will be described in greater detail below. This top edge could also be rounded with a radius, as shown in FIG. 5*a*, or formed with a bevel to serve the same purpose. The innermost end of the groove 28 is formed with a bay of reduced radial diameter and reduced depth to receive the cartridge follower, in a manner that will be described below. The wall 30 is preferably formed integrally with the bottom wall 38 to thereby rigidly stabilize the width of the slot 28 through all of its flights.

Figure 5:
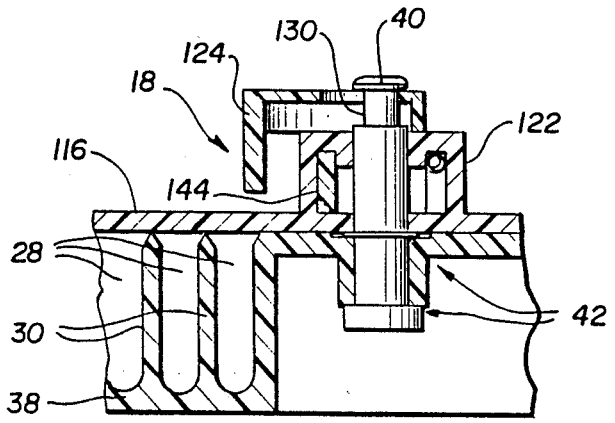

At the center of the spiral defined by the wall 30, the loader 10 is formed with a pin 40. The lid assembly 18, as shown in FIG. 5, cooperates with this pin 40 to hold the lid assembly 18 removably but snugly on top of the spiral groove 28 in order to restrain the cartridges therein. FIG. 2 shows the lid assembly mounted in place with the cartridges therein. Many parts of the lid assembly are made of transparent material so that the user can observe the invention in operation. The pin 40 is mounted so that it does not rotate about its own axis within the spiral groove and, to this end, a collar and snap ring assembly, generally designated 42, is provided. Any other suitable means to mount a pin in a rigid fashion may be used.

Figure 11:
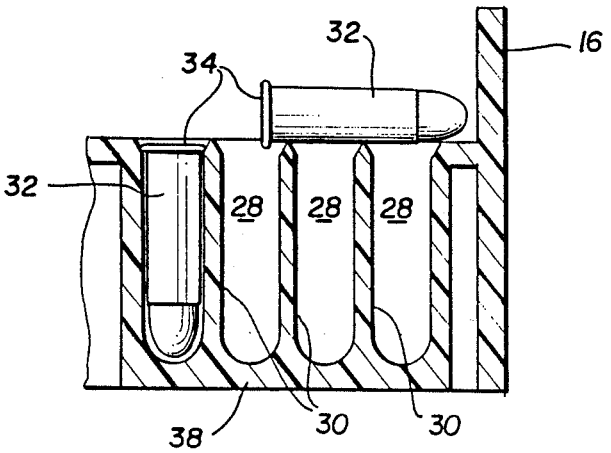
FIG. 11 is a partial cross-sectional view taken on line 11—11 of FIG. 10.

The total developed length of the spiral slot 28 is designed to be greater than, in fact in the preferred embodiment it is 50% greater than, 100 times the diameter of a single cartridge 32. This extra length of slot 28 permits loading an even larger number of cartridges than the 100 accepted by the magazine 12, and also facilitates use of the invention as discussed below and as is shown in FIGS. 10 and 11.

The manner in which the handle assembly 22 is used to load the cartridges into the magazine 12 is best illustrated in FIGS. 2 and 3. The handle assembly 22 comprises a manual spinner type handle 44, a main crank arm 46, a main shaft 48, and a cam 50 at the inner end of the main shaft 48. The cam 50 carries a feed finger operating pin 52 on its inside, that is, the side facing the crank arm 46. The handle assembly is rotatably mounted on the main body by means of a bearing pillow block type assembly 54. A vertical cartridge stop in the form of an inverted "U" shaped member is mounted on the main body between the magazine socket 14 and the shaft housing 54. This stop 56 constrains the motion of the cartridges under the urging of the feed finger 58 to prevent the cartridges from moving anywhere but out of the spiral groove, under the stop 56, and into the magazine.

As is best shown in FIG. 3, the cam 50 is of a generally tear drop shape. It is pivoted to the main shaft of the handle 48 at its axis of rotation. Thus, as best shown in FIG. 3, when the handle is rotated in the direction of the arrow in FIG. 3, the pin 52 will first engage the crotch between the main body of the feed finger 58 and the lifter leg portion 60 of the feed finger. This motion will cause the feed finger to pivot to the right as shown in FIG. 3 in its track 62. Thereafter, further rotation of the cam 50 will cause the feed finger to lift upwardly from that rotated position. This will cause the corner 64 of the feed finger to lift a cartridge by its rim and force it under the vertical stop 56 and through the magazine's feed lips and into the magazine 12. The upper end of the front surface of the feed finger is hollowed slightly as at 65 to to snugly mate with the rounded body of the shell portion of each cartridge 62. This facilitates the finger's grasping and holding and lifting the cartridge to insert it into the magazine, as shown in FIG. 3. The hollow 65 also appears in FIG. 2 in dotted lines. A return spring 66 is trained between a fixed anchor on the body and a moving anchor on the lower end of the feed finger 58, as shown. This spring will return the feed finger to the solid line position of FIG. 3 when the cam 50 has rotated approximately 120° to 150° in the direction of the arrow shown in FIG. 3. At that time the pin 52 will slip out from under the lifter leg 60, and the tension spring 66 will return the feed finger 58 back to the solid line position of FIG. 3. Other means not shown are provided planes to constrain the motion of the feed finger to the planes of FIG. 3. That is, the feed finger is not free to move in and out with respect to the paper in FIG. 3, but only between the solid and the dot dash line positions shown in FIG. 3.

Thus, it can be appreciated that the feed finger 58 in effect "floats". It is permitted to both reciprocate and rock in the plane of the paper as shown in the drawings. In the rocking motion it urges the cartridge into the magazine, and then on the sliding motion it pushes that same cartridge "home" through the feed lips and into the magazine.

Means are provided to prevent the cartridges 32 from exiting from the radially outer end of the spiral groove 28 unless a magazine 12 is positioned in the socket 14. Referring now to FIGS. 2 and 4, to this end there is provided an assembly 68 which is made up of a plate 70 carrying two plungers 72 and 74. A spring 76 normally urges the plunger assembly 68 to the up position as shown in FIG. 4.

Thus, the plunger 74 stands normally at the exit end of the spiral slot 28, the point just when the cartridges leave the spiral slot, exit under the vertical stop 56, and then will be in position to be picked up by the corner 64 of the feed finger 58. If there is no magazine in the socket 14, then the cartridges will be stopped at the exit end of the spiral slot by the plunger 74 as shown in FIG. 2. When there is a magazine in the socket, it will depress the plunger 72 against the spring 76, which will in turn withdraw the plunger 74 and allow the cartridges to advance under the stop 56 in position to be inserted by the finger. A housing 78 is provided at the underside of the main body, that is, below the socket 14, to contain the assembly of parts 70, 72, 74 and 76, and to permit their operation in the manner described above.

For the remaining portion of each rotation of the cam 50, it drives a shuttle assembly 82 which rides, preferably, in a dovetail groove 84 (see FIG. 2) formed in a shuttle guide 80. The shuttle guide 80 can be a separate block as shown, or could be formed integrally with the main body of the loader 10. The ratchet housing cover 20 is secured by screws or the like 86 (see FIG. 1) which join the cover to the shuttle guide 80.

The shuttle assembly comprises a main body portion 88 which slides in the dovetail groove 84 and in the base groove of the shuttle guide. It carries a top member 90. A relatively stiff spring 92 interconnects the two members 88 and 90, and that spring 92 is the only driving engagement between those two parts. The top member 90 carries other parts as will be described below. Accordingly, the spring 92 serves as a safety overload in the event of a jam or other malfunction. This will prevent breaking of parts and the like. That is, if there is a jam, the top member 90 can remain stationary, and the spring 92 will absorb the excess motion.

Means are provided to rotate the lid assembly 18 to thereby drive the cartridges 32 through the spiral slot and into the magazine 12, in the manner shown. This motion of the lid assembly is accomplished by a pawl and ratchet assembly 94. The assembly 94 comprises a drive pawl 96 which is pivoted at 100 to the top member 90 of the shuttle assembly. An extension spring 102 normally urges the feed end 98 of the drive pawl 96 into engagement with the ratchet teeth on the lid, as shown in FIG. 2. The pawl and ratchet assembly further comprises a stationary pawl 104 which is urged by a spring 106 about the common pivot 108 of the spring and the pawl to the fixed shuttle guide 80. The stationary pawl 104 is also formed with a feed end 110 which likewise engages the teeth of the lid. Near the feed end 110, pawl 104 carries a pin 112 to which is pivotally mounted a disengagement lever 114. By manually urging the lever 114 downwardly and to the right as shown in FIG. 2 both pawl feed ends 98 and 110 will be disengaged from the teeth in the lid in one motion by lever 114, thereby facilitating positioning and removal of the lid into and out of the well. The two pawls 96 and 104 are coplanar. Thus, disengaging motion of the lever 114 will first disengage the feed end 110, the backside of the pawl 104 will then engage the front side of the drive pawl 96, and further motion of the lever 114 will disengage the feed end 108 by rotating the pawl 96 about its pivot 100. Releasing the lever 114 will permit the two springs 102 and 106 to return their respective pawls to driving engagement with the teeth on the lid, which is the position shown in FIG. 2.

The lid assembly is shown in detail in FIGS. 1, 2 and 6, and in the cross-sectional views of FIGS. 7, 8 and 9. The lid assembly comprises a disc 116 and a combined handle and housing assembly 118 mounted diametrically on the top surface thereof. The entire outer circumference of the disc 116 is formed with ratchet teeth 120 which cooperate with the pawls 96 and 104 to feed the cartridges through the spiral groove 28.

The assembly 118 comprises a inverted "U" shaped housing 122. A latch member 124 is pivotally mounted to the housing 122 on a pin 126. A spring, not shown, is provided between the latch 124 and the top of the housing 122 to normally urge the latch 124 into the position shown in FIG. 2. An elongated slot 128 engages a reduced neck portion 130 on the pin 40 to removably and rotatably hold the lid assembly 18 on the fixed pin 40.

Thus, the lid assembly 18 can be removed from and attached to the remainder of the invention loader by depressing latch 124 about its pivot 126 opposite to the direction indicated by the arrow. At the same time, lever 114 can be operated to disengage the pawls. Then, the elongated slot 128 will permit simply lifting the entire lid assembly 18 off of the pin 40.

The handle and housing assembly 118 comprises a slider block 132 which carries a cartridge follower member 134. The follower 134 is mounted on a pivot pin 136 which extends through the block 132 and terminates at a rocker arm 138. A spring 140 is connected to one end of arm 138 and normally holds the follower in the position shown in FIG. 2. Inclined surfaces 142 define the limits of rotation of the arm 138 and thus of the follower 134. These parts are dimensioned so as to permit the follower to track through the spiral groove as its radius changes from the innermost part to the outermost part to thus drive all of the cartridges through the groove smoothly. The slider block 132 is formed with a guide leg 144 which is constrained for motion in suitably formed mating grooves in the inside of the handle housing 122 to constrain the block 132 and thus the follower 134 to smooth motion within the housing 122 and thus radially of the well and the spiral slot.

Spring 140 will normally hold the block 132 and thus the follower at the radially innermost part of the lid assembly. The inclined surfaces 142 will hold the follower in proper position to enter the bay 36 when the arrows 24 and 26 are lined up and the lid is inserted into the well and onto the pin 40 in assembling the parts for use. At this time, the spiral slot will may be full of cartridges 32 hanging therein by their rims.

Means are provided to prevent disengagement of the lid assembly from the pin 40 when the cartridge follower 134 is in the outermost flight of the spiral groove and especially when the follower is under the vertical stop 56. To this end, a set of interferring lugs 146 and 148 are provided on the latch 124 and the guide leg 144. The sizes and positions of these lugs 146 and 148 are such that they will interfere with each other only when the follower is in the outermost flight of the spiral groove or under the vertical stop 56. This feature prevents damage to the cartridge follower 134 as might because if an attempt were made to remove the lid assembly while the follower 134 were under the vertical stop. Thus, to disengage the lid from the remainder of the loader after all cartridges have been emptied out of the spiral groove and into the magazine, the user must first operate the lever 114 to disengage the pawls, then rotate the lid backwards to get the follower out of the outermost flight of the spiral groove, and then may operate the latch 124 to disengage the lid assembly from the pin 40.

It has been found that the housing 122 serves quite adequately as a handle. However, if desired, a knob or the like could be added to further facilitate use.

Another optional feature is the addition of feet to raise the loader up off the table or other point of use. If done, these would appear in, for example, FIG. 3, at the two bottom corners and extending downwardly from the main body 10.

The invention operates more comfortably and more reliably if the cartridges are allowed to be assisted by the force of gravity in exiting through the vertical stop 56 and going into the magazine. To this end, the main body is formed with a surface 150. In use, the user can preferably lay the loader 10 with a magazine 12 positioned in the socket 14 on this surface 150. That is, with the axis of the magazine horizontal. Then the handle can be operated, the axis of the main shaft 48 also being horizontal at that time, and gravity will assist in loading the magazine.

OPERATION OF THE INVENTION

Referring now to FIG. 10, the invention is extremely simple to use. Experimental work has shown that it is highly efficient and reliable, and repeatedly and rapidly loads 100 .22 long rifle cartridges into the magazine of our prior patents.

The loader is first set upright, the position of FIG. 1, and the lid is removed. This is done by being sure the follower in the lid is not in the last flight of the groove 28 and is not under the stop 56. If that is the case, operation of the lever 114 and depression of the lever 124 will permit the lid assembly to be removed. Then, 100 cartridges can be simply "dumped" on the top of the spiral group. This is shown in the top plan view of FIG. 10. The user can then grasp the entire loader with the cartridges in the well in both hands, and gently agitation will very quickly, in only a few seconds, urge all of the cartridges into the spiral slot. This happens naturally because of the heavy lead nose on each cartridge. Sometimes, after the groove is substantially filled, it may be quicker for the user to take a finger and "help" the last two or three cartridges into the slot.

After the slot is full of cartridges, the lid is remounted in position in the well by aligning the arrows 24 and 26, moving the lever 114 radially outwardly to disengage both pawls, and operating the latch 124 to reengage the parts in the position shown in FIG. 1. Thereafter, the user manually rotates the lid using the handle 118 until the follower 134 has compressed the cartridges into a solid spiral line against the blocking plunger 74. The user then inserts an empty magazine 12 into the socket 14. This depresses the plunger 72 as well as the companion plunger 74, and allows the cartridges to be ready to exit from the spiral slot 28, go under the vertical stop 56, and be ready to be inserted into the magazine by the feed finger 58, using the corner 64 thereof with the hollow 65 therein.

The loader is now ready to be operated to move and insert all 100 cartridges rapidly into the magazine. To facilitate this, the user may wish to set it on its side, on the surface 150. In either case, that is, vertically or horizontally, the user can then operate the spinner handle of the crank assembly 22 as quickly as he can, in the clockwise direction, and the magazine will be rapidly filled with the 100 cartridges.

During the loading operation, the eccentric cam 50 moves the shuttle through its full stroke for each cartridge, unless the lid jams, or the loader is empty of cartridges. In either case, the overload spring 92 will absorb the excess motion of the cam, allowing the main body of the shuttle 88 to remain stationary until the jam is cleared.

The drive pawl engages the ratchet teeth around the lid to radially advance the lid for each cartridge. The follower spring 92 will again absorb excess motion when the cartridges strike against the stop plunger 74 if there is no magazine in place. The fixed pawl acts on the teeth of the lid to prevent the lid from moving in reverse as the drive pawl goes into and out of contact with the same lid teeth in advancing the lid assembly for each cartridge.

Thus, again with reference to FIG. 3, overall, it can be seen that on the first part of each rotation a cartridge is inserted into the magazine, and then on the latter part of each rotation the lid is rotated by the pawl arrangement to put another cartridge in position ready to be inserted on the first half of the next rotation of the cam 50.

While the invention has been described in detail above, it is to be understood that this detailed description is by way of example only, and the protection granted is to be limited only by the spirit of the invention and the scope of the following claims.

What is claimed is:

1. A device for rapidly loading a predetermined number of cartridges into a firearm magazine, said magazine comprising cartridge entry means, each said cartridge comprising a cylindrical body and a rim portion extending radially outwardly of said cartridge body, said rim portion being located at one end of said cartridge and said cartridge comprising a relatively heavy nose portion at the other end thereof, said device comprising a loader body, means to removably mount said magazine on said loader body, feed finger means mounted on said loader body, means to cause said feed finger means to move with a first predetermined motion to first cause a cartridge engaged at its said rim by said feed finger means to move laterally towards said magazine cartridge entry means and to thereafter cause said feed finger means to move with a second predetermined motion to secondly cause that same cartridge to move longitudinally through said magazine cartridge entry means and into said magazine, and said first and second predetermined motions being different from each other.

2. The device of claim 1, said means to removably mount said magazine on said loader body comprising socket means for receiving said magazine, said loader body being formed with a spiral wall defining a spiral groove, said groove having a uniform radial thickness of a dimension larger than the diameter of said cartridge body but smaller than the diameter of said cartridge rim, said groove having a depth greater than the length of each said cartridge, said spiral wall being joined to said loader body at one end of its height and the other end of its height defining a plane which is positioned generally horizontally when said cartridges are put into said groove, whereby said cartridges may be placed randomly on said plane and will fall nose first by gravity and due to said relatively heavy nose portion into said groove upon shaking of said loader when said cartridges are on said plane, the length of said groove being greater than the sum of the diameters of said predetermined number of said cartridges to be loaded into said magazine, means at said plane defining end of said spiral wall to permit said cartridges to hang therefrom and into said spiral groove with all portions of said cartridges below said plane in said generally horizontal position, and means to communicate the radially outermost end of said spiral groove to said magazine cartridge entry means, whereby said cartridges may be fed out of said spiral groove and into a magazine positioned on said loader with said cartridge entry means of said magazine open to one end of said spiral groove.

3. The device of claim 1, further comprising manual crank means and means to rotatably mount said crank means on said loader body, said crank means comprising eccentrically mounted cam means, said device comprising means to feed said predetermined number of cartridges one by one into said magazine, said device comprising means to advance all of said predetermined number of said cartridges all at once to said feeding means, and said cam means comprising means to operate said feeding means to feed one cartridge into said magazine and to perform both of said first and said second predetermined motions during a portion of each cycle of operation of said manual crank means and to operate said advancing means to advance all of the remaining ones of said predetermined number of said cartridges to said feeding means during another portion of each said cycle of operation of said manual crank means.

4. The device of claim 2, further comprising a lid and follower assembly, said spiral groove being formed with a reduced size bay at its radially innermost portion, said bay being too small to accept a said cartridge therein, said lid and follower assembly comprising a generally circular lid and a follower foot, means at said plane defining end of said spiral wall to permit said cartridges to hang therefrom and into said spiral groove with all portions of said cartridges below said plane when said loader is in said generally horizontal position, said lid being of a shape to seat on top of said plane to thereby hold said cartridges trapped in said spiral groove, and spring means on said lid and follower assembly urging said follower foot radially inwardly of said lid towards the center thereof and in a position to enter said bay when said lid is in place on said plane in a predetermined arcuate orientation between said lid and follower assembly and said follower foot.

5. The device of claim 4, said lid being formed with ratchet teeth all around the periphery thereof, ratchet drive means mounted on said loader body in position to cooperate with said ratchet teeth, said feed finger means acting to feed said cartridges one by one into said magazine, means to operate said ratchet drive means to advance said follower foot in an outward spiral through said spiral groove, cam means and means to mount said cam means on said loader body, and said cam means operating said feed finger means to feed one cartridge into said magazine during a portion of each cycle of operation of said cam means and to advance said follower foot via said ratchet drive means and said lid ratchet teeth outwardly through said spiral groove an arcuate distance equal to at least one cartridge diameter during another portion of each said cycle of operation of said cam means, whereby for each cycle of operation of said cam means one cartridge is fed into said magazine and all of the remaining cartridges are advanced one cartridge position through said spiral groove towards said feed means.

6. The device of claim 5, further comprising means to manually disengage said lid ratchet teeth and said ratchet drive means to facilitate mounting and dismounting of said lid and follower assembly with respect to said loader body.

7. The device of claim 2, further comprising a lid assembly comprising a lid and follower means adapted to advance said cartridges through said spiral groove, said follower means comprising shuttle means mounted on said lid for radial motion thereon, and said shuttle means including motion absorbing means, whereby said lid can be moved a uniform arcuate distance as each cartridge is fed into said magazine and said follower means advances an arcuate distance less than said uniform distance, and said arcuate distance less than said uniform distance changing for each cartridge dependant upon the radial location of said follower means in said spiral groove.

8. The device of claim 2, further comprising lid means for said spiral groove to hold said cartridges therein during loading of said cartridges into said magazine, and said lid means comprising a lid member consisting of transparent material.

9. The device of claim 2, further comprising means to prevent said cartridges from exiting said spiral groove unless a magazine is positioned on said loader.

10. The device of claim 9, said means for removably mounting said magazine on said loader body comprising socket means formed in said loader body, said preventing means comprising a "U" shaped plunger having two legs and a first position wherein one of said legs extends into the inside space defined by said socket means and the other of said legs blocks the cartridge exit end of said spiral groove, and spring means normally urging said plunger into said first position, whereby insertion of a magazine into said socket pushes said plunger via said one leg out of said first position and into a second position wherein said second leg does not block said cartridge exit end of said spiral groove.

11. The device of claim 2, said loader body being formed with a wall surrounding said spiral groove and extending above said plane in said horizontal position of said loader, said wall defining a well above said spiral groove to accept cartridges dumped therein and to prevent loss of said cartridge out of said loader during said shaking of said loader.

12. The device of claim 2, said cartridge hanging means at said plane defining end of said spiral wall comprising a beveled edge whereby the motion of said cartridges through said spiral groove is facilitated.

13. The device of claim 2, said cartridge hanging means at said plane defining end of said spiral wall comprising a radius, whereby the motion of said cartridges through said spiral groove is facilitated.

14. The device of claim 1, further comprising eccentric cam means mounted on said loader body, means to cause said eccentric cam means to move with a rotational motion, and means to cause said cam means to cause said feed finger means to move with both said first and said second predetermined motions.

15. The device of claim 14, said feed finger means comprising a floating feed finger, said feed finger comprising a lifter leg portion, said cam means engaging said lifter leg portion to cause said first and second predetermined motions to occur in sequence for each cartridge fed into said magazine, said feed finger means including spring means to return said feed finger to a start position after continued rotation of said cam means moves said cam means out of engagement with said lifter leg, and said feed finger means including means to constrain the motion of said feed finger substantially to a single plane.

16. The device of claim 2, and said loader body being formed with a surface thereon so positioned that when said loader body is placed on said surface said cartridges will exit said spiral groove and will move toward said magazine cartridge entry means assisted by the force of gravity.

17. A device for rapidly loading a predetermined number of cartridges into a firearm magazine, said magazine comprising cartridge entry means, each said cartridge comprising a cylindrical body and a rim portion extending radially outwardly of said cartridge body, said rim portion being located at one end of said cartridge and said cartridge comprising a relatively heavy nose portion at the other end thereof, said device comprising a loader body, said loader body being formed with socket means for receiving said magazine, said loader body being formed with a spiral wall defining a spiral groove, said groove having a uniform radial thickness of a dimension larger than the diameter of said cartridge body but smaller than the diameter of said cartridge rim, said groove having a depth greater than the length of each said cartridge, said spiral wall being joined to said loader body at one end of its height and the other end of its height defining a plane which is positioned generally horizontally when said cartridges are to be loaded into said groove, whereby said cartridges may be placed randomly on said plane and will fall nose first by gravity and due to said relatively heavy nose portion into said groove upon shaking of said loader when said cartridges are on said plane, the length of said groove being greater than the sum of the diameters of said predetermined number of said cartridges to be loaded into said magazine, and means to communicate the radially outermost end of said spiral groove into said magazine cartridge entry means, whereby said cartridges may be fed out of said spiral groove and into a magazine positioned in said socket with said cartridge entry means of said magazine open to said spiral groove's outermost end.

18. The device of claim 17, further comprising manual crank means and means to rotatably mount said crank means on said loader body, said crank means comprising eccentrically mounted cam means, said device comprising means to feed said predetermined number of cartridges one by one through said spiral groove and into said magazine, said device comprising means to advance all of said predetermined number of said cartridges all at once through said spiral groove and to said feeding means, and said cam means comprising means to operate said feeding means to feed one cartridge into said magazine during a portion of each cycle of operation of said manual crank means and to operate said advancing means to advance all of the remaining ones of said predetermined number of said cartridges to said feeding means during another portion of each said cycle of operation of said manual crank means.

19. The device of claim 17, further comprising a lid and follower assembly, said spiral groove being formed with a reduced size bay at its radially innermost portion, said bay being too small to accept a said cartridge therein, said lid and follower assembly comprising a generally circular lid and a follower foot, means at said plane defining end of said spiral wall to permit said cartridges to hang therefrom and into said spiral groove with all portions of said cartridges below said plane when said loader is in said generally horizontal position, said lid being of a shape to seat on top of said plane to thereby hold said cartridges trapped in said spiral groove, and spring means on said lid and follower assembly urging said follower foot radially inwardly of said lid towards the center thereof and in a position to enter said bay when said lid is in place on said plane in a predetermined arcuate orientation between said lid and follower assembly and said follower foot.

20. The device of claim 19, said lid being formed with ratchet teeth all around the periphery thereof, ratchet drive means mounted on said loader body in position to cooperate with said ratchet teeth, feed finger means to feed said cartridges one by one into said magazine, means to operate said ratchet drive means to advance said follower foot in an outward spiral through said spiral groove, cam means and means to mount said cam means on said loader body, and said cam means operating said feed finger means to feed one cartridge into said magazine during a portion of each cycle of operation of said cam means and to advance said follower foot via said ratchet drive means and said lid ratchet teeth outwardly through said spiral groove an arcuate distance equal to at least one cartridge diameter during another portion of each said cycle of operation of said cam means, whereby for each cycle of operation of said cam means one cartridge is fed into said magazine and all of the remaining cartridges are advanced one cartridge position through said spiral groove towards said feed means.

21. The device of claim 20, further comprising means to manually disengage said lid ratchet teeth and said ratchet drive means to facilitate mounting and dismounting of said lid and follower assembly with respect to said loader body.

22. The device of claim 17, further comprising a lid assembly comprising a lid and follower means adapted to advance said cartridges through said spiral groove, said follower means comprising shuttle means mounted on said lid for radial motion thereon, and said shuttle means including motion absorbing means, whereby said lid can be moved a uniform arcuate distance as each cartridge is fed into said magazine and said follower means advances an arcuate distance less than said uniform distance, and said arcuate distance less than said uniform distance changing for each cartridge dependant upon the radial location of said follower means in said spiral groove.

23. The device of claim 17, further comprising lid means for said spiral groove to hold said cartridges therein during loading of said cartridges into said magazine, and said lid means comprising a lid member consisting of transparent material.

24. The device of claim 17, further comprising means to prevent said cartridges from exiting said spiral groove unless a magazine is positioned on said loader.

25. The device of claim 24, said means for removably mounting said magazine on said loader comprising socket means formed in said loader body, said preventing means comprising a "U" shaped plunger having two legs and a first position wherein one of said legs extends into the inside space defined by said socket means and the other of said legs blocks the cartridge exit end of said spiral groove, and spring means normally urging said plunger into said first position, insertion of a magazine into said socket pushes said plunger via said one leg out of said first position and into a second position wherein said second leg does not block said cartridge exit end of said spiral groove.

26. The device of claim 17, said loader body being formed with a wall surrounding said spiral groove and extending above said plane in said horizontal position of said loader said wall defining a well above said spiral groove to accept cartridges dumped therein and to prevent loss of said cartridge out of said loader during said shaking of said loader.

27. The device of claim 17, said cartridge hanging means at said plane defining end of said spiral wall comprising a beveled edge whereby the motion of said cartridges through said spiral groove is facilitated.

28. The device of claim 17, said cartridge hanging means at said plane defining end of said spiral wall comprising a radius, whereby the motion of said cartridges through said spiral groove is facilitated.

29. The device of claim 17, and said loader body being formed with a surface thereon so positioned that when said loader body is placed on said surface said cartridges will exit said spiral groove and will move toward said magazine cartridge entry means assisted by the force of gravity.

30. A device for rapidly loading a predetermined number of cartridges into a firearm magazine, said magazine comprising cartridge entry means, each said cartridge comprising a cylindrical body and a rim portion extending radially outwardly of of said cartridge and said cartridge comprising a relatively heavy nose portion at the other end thereof said device comprising a loader body, said loader body being formed with means for removably mounting said magazine thereon, manual crank means and means to rotatably mount said crank means on said loader body, said crank means comprising eccentrically mounted cam means, said device comprising means to feed said predetermined number of cartridges one by one into said magazine, said device comprising means to advance all of said predetermined number of said cartridges all at once to said feeding means, and said cam means comprising means to operate said feeding means to feed one cartridge into said magazine during a portion of each cycle of operation of said manual crank means and to operate said advancing means to advance all of the remaining ones of said predetermined number of said cartridges to said feeding means during another portion of each said cycle of operation of said manual crank means.

31. The device of claim 30, said means for removably mounting said magazine on said loader body comprising socket means for receiving said magazine, said loader body being formed with a spiral wall defining a spiral groove, said groove having a uniform radial thickness of a dimension larger than the diameter of said cartridge body but smaller than the diameter of said cartridge rim, said groove having a depth greater than the length of each said cartridge, said spiral wall being joined to said loader body at one end of its height and the other end of its height defining a plane which is positioned generally horizontally when said cartridges are put into said groove, whereby said cartridges may be placed randomly on said plane and will fall nose first by gravity and due to said relatively heavy nose portion into said groove upon shaking of said loader when said cartridges are on said plane, the length of said groove being greater than the sum of the diameters of said predetermined number of said cartridges to be loaded into said magazine, means at said plane defining end of said spiral wall to permit said cartridges to hang therefrom and into said spiral groove with all portions of said cartridges below said plane in said generally horizontal position, and means to communicate the radially outermost end of said spiral groove to said magazine cartridge entry means, whereby said cartridges may be fed out of said spiral groove and into a magazine positioned on said loader with said cartridge entry means of said magazine open to one end of said spiral groove.

32. The device of claim 31, said advancing means comprising a lid and follower assembly, said spiral groove being formed with a reduced size bay at its radially innermost portion, said bay being too small to accept a said cartridge therein, said lid and follower assembly comprising a generally circular lid and a follower foot, means at said plane defining end of said spiral wall to permit said cartridges to hang therefrom and into said spiral groove with all portions of said cartridges below said plane when said loader is in said generally horizontal position, said lid being of a shape to seat on top of said plane to thereby hold said cartridges trapped in said spiral groove, and spring means on said lid and follower assembly urging said follower foot radially inwardly of said lid towards the center thereof and in a position to enter said bay when said lid is in place on said plane in a predetermined arcuate orientation between said lid and follower assembly and said follower foot.

33. The device of claim 32, said lid being formed with ratchet teeth all around the periphery thereof, ratchet drive means mounted on said loader body in position to cooperate with said ratchet teeth, and means to operate said ratchet drive means to advance said follower foot in an outward spiral through said spiral groove.

34. The device of claim 32, said lid assembly comprising shuttle means mounted on said lid for radial motion thereon, and said shuttle means including motion absorbing means, whereby said lid can be moved a uniform arcuate distance as each cartridge is fed into said magazine and said follower means advances an arcuate distance less than said uniform distance, and said arcuate distance less than said uniform distance changing for each cartridge dependant upon the radial location of said follower mean in said spiral groove.

35. The device of claim 32, further comprising means to manually disengage said lid ratchet teeth and said ratchet drive means to facilitate mounting and dismounting of said lid and follower assembly with respect to said loader body.

36. The device of claim 32, further comprising means to prevent said cartridges from exiting said spiral groove unless a magazine is positioned on said loader.

37. The device of claim 36, said means for removably mounting said magazine on said loader body comprising socket means in said loader body, said preventing means comprising a "U" shaped plunger having two legs and a first position wherein one of said legs extends into the inside space defined by said socket means and the other of said legs blocks the cartridge exit end of said spiral groove, and spring means normally urging said plunger into said first position, whereby insertion of a magazine into said socket pushes said plunger via said one leg out of said first position and into a second position wherein said second leg does not block said cartridge exit end of said spiral groove.

38. The device of claim 32, said loader body being formed with a wall surrounding said spiral groove and extending above said plane in said horizontal position of said loader, said wall defining a well above said spiral groove to accept cartridges dumped therein and to prevent loss of said cartridge out of said loader during said shaking of said loader.

39. The device of claim 32, said cartridge hanging means at said plane defining end of said spiral wall comprising a beveled edge whereby the motion of said cartridges through said spiral groove is facilitated.

* * * * *